US007726992B2

(12) United States Patent
Wang et al.

(10) Patent No.: US 7,726,992 B2
(45) Date of Patent: Jun. 1, 2010

(54) RF CONNECTOR HAVING CONTACT TERMINAL SET WITH MOVABLE BRIDGE

(75) Inventors: Leland Wang, Shenzhen (CN); Shih-Chi Hsiao, Tu-cheng (TW); Jin-Liang Du, ShenZhen (CN); Jun Zhou, ShenZhen (CN); Zheng-Wang Wu, ShenZhen (CN); Shuo-Bin Ru, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/586,787

(22) Filed: Sep. 28, 2009

(65) Prior Publication Data

US 2010/0081308 A1 Apr. 1, 2010

(30) Foreign Application Priority Data

Sep. 26, 2008 (CN) ..... 2008 2 0160052 U

(51) Int. Cl.
*H01R 29/00* (2006.01)

(52) U.S. Cl. ..... 439/188; 439/944

(58) Field of Classification Search ..... 439/63, 439/188, 944
See application file for complete search history.

(56) References Cited

U.S. PATENT DOCUMENTS

| | | | | |
|---|---|---|---|---|
| 6,554,630 | B2 | 4/2003 | Murata | |
| 6,843,673 | B1 * | 1/2005 | Liu et al. | 439/188 |
| 6,939,152 | B1 * | 9/2005 | Chen | 439/188 |

* cited by examiner

*Primary Examiner*—Tho D Ta
(74) *Attorney, Agent, or Firm*—Wei Te Chung; Andrew C. Cheng; Ming Chieh Chang

(57) ABSTRACT

A RF connector comprising: an insulative housing defining a space section; an upper fixed contact and a lower movable contact are disposed on two opposite sides of the housing in a first direction, each of said upper fixed contact and said lower movable contact including a contact section in the space section and a solder tail exposed outside of the housing, the lower movable contact having on two opposite sides a pair of bending ends disposed which is a lying U-shape; and an upper case mounted upon the housing and defining a plug insertion passageway; and a metallic shell enclosing said upper case and the housing.

16 Claims, 4 Drawing Sheets

RF CONNECTOR HAVING CONTACT TERMINAL SET WITH MOVABLE BRIDGE

BACKGROUND OF THE INVENTION

1. Field of the Invention

The present invention relates to a RF connector, and more particularly, to a RF connector having contact terminal set with a moveable bridge selectively disconnecting an upper and a lower parts.

2. Background of the Invention

RF connectors are known to set up an electrical connection between an electronic component and a printed circuit board. U.S. Pat. No. 6,554,630 issued to Murata on Apr. 29, 2003 discloses a type of connector mounted to a printed circuit board. The connector comprises a frame, a movable spring portion having two ends that are supported by the frame and a central portion thereof that is movable and is elastic; a contact portion that is integral with the movable spring portion and that is arranged to come into contact with and connect to a fixed terminal; a fixed portion that is integral with the frame and is arranged to be sandwiched by an upper insulating case portion and a lower insulating case portion of a RF connector; and a lead extending from the fixed portion; wherein the fixed portion includes at least one recess provided therein for being fitted to a leg disposed on the upper insulating case portion of the RF connector so as to accurately locate the movable terminal with respect to the upper insulating case portion.

Unfortunately, problems are encountered with the RF connectors mentioned above. The top surface of the movable spring portion presents a shape of arc providing a point contact with a contact of a complementary connector. This kind of structure always leads to a misconnection between the mating coaxial connector and the RF connector due to providing a point contact therebetween.

Hence, an improved RF connector is needed to solve the above problem.

SUMMARY OF THE INVENTION

An object, therefore, of the invention is to provide a new and improved RF connector of the character described able to provide a planar surface contact, thereby preventing the misconnection between the RF connector and the mating coaxial connector.

In order to achieve the object set forth, a RF connector in accordance with the present invention comprises an insulative housing defining a space section; an upper fixed contact and a lower movable contact are disposed on two opposite sides of the housing in a first direction, each of said upper fixed contact and said lower movable contact including a contact section in the space section and a solder tail exposed outside of the housing, the lower movable contact having on two opposite sides a pair of bending ends disposed which is a lying U-shape; and an upper case mounted upon the housing and defining a plug insertion passageway; and a metallic shell enclosing said upper case and the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
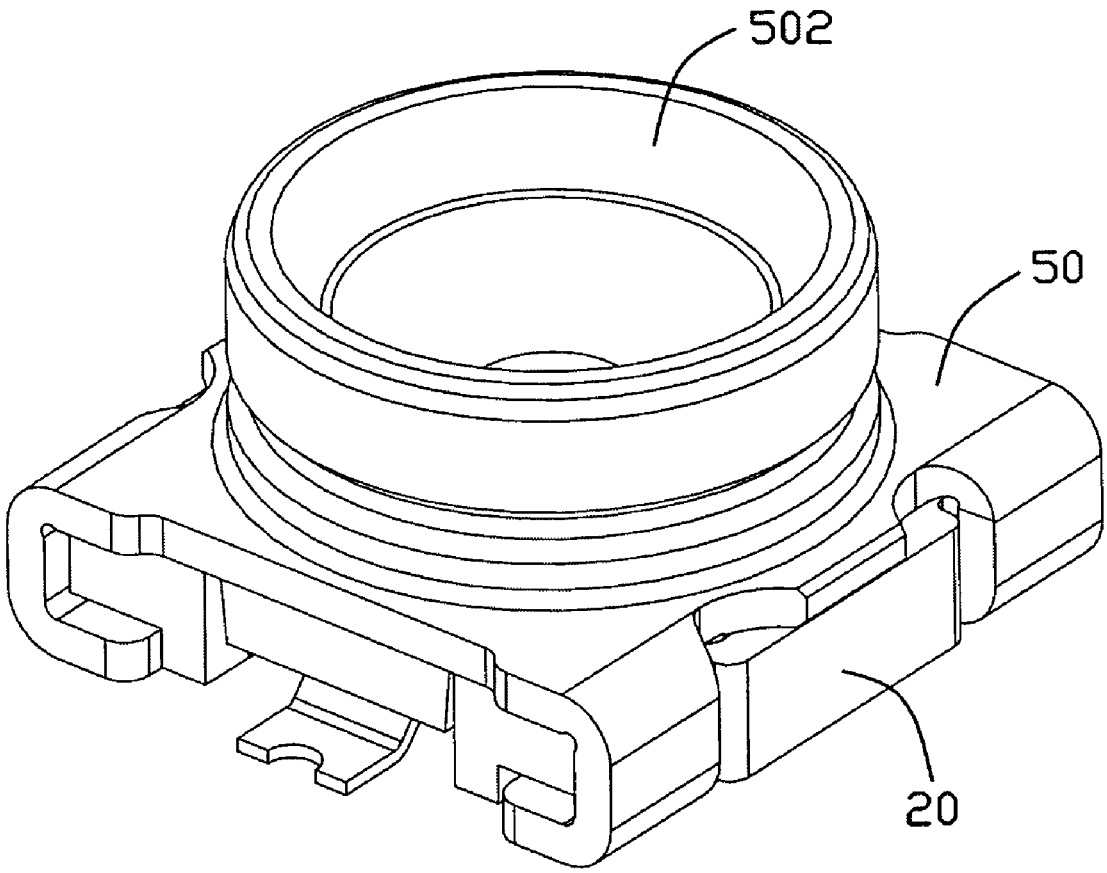
FIG. 1 is an assembled, perspective view of the RF connector.

Referring to FIGS. 1-4, a RF connector for receipt of a central contact of a mating coaxial connector to be inserted therein, comprises an insulative case including an upper insulative case portion 10 and a lower insulative case portion 20, the lower insulative case portion 10 defining a space section 201 thereof; an upper fixed contact 30; a lower movable contact 40, the lower movable contact 40 essentially stacked in a vertical direction and received in the space section 201; and a metal shell 50 shielding the insulative case.

Figure 2:
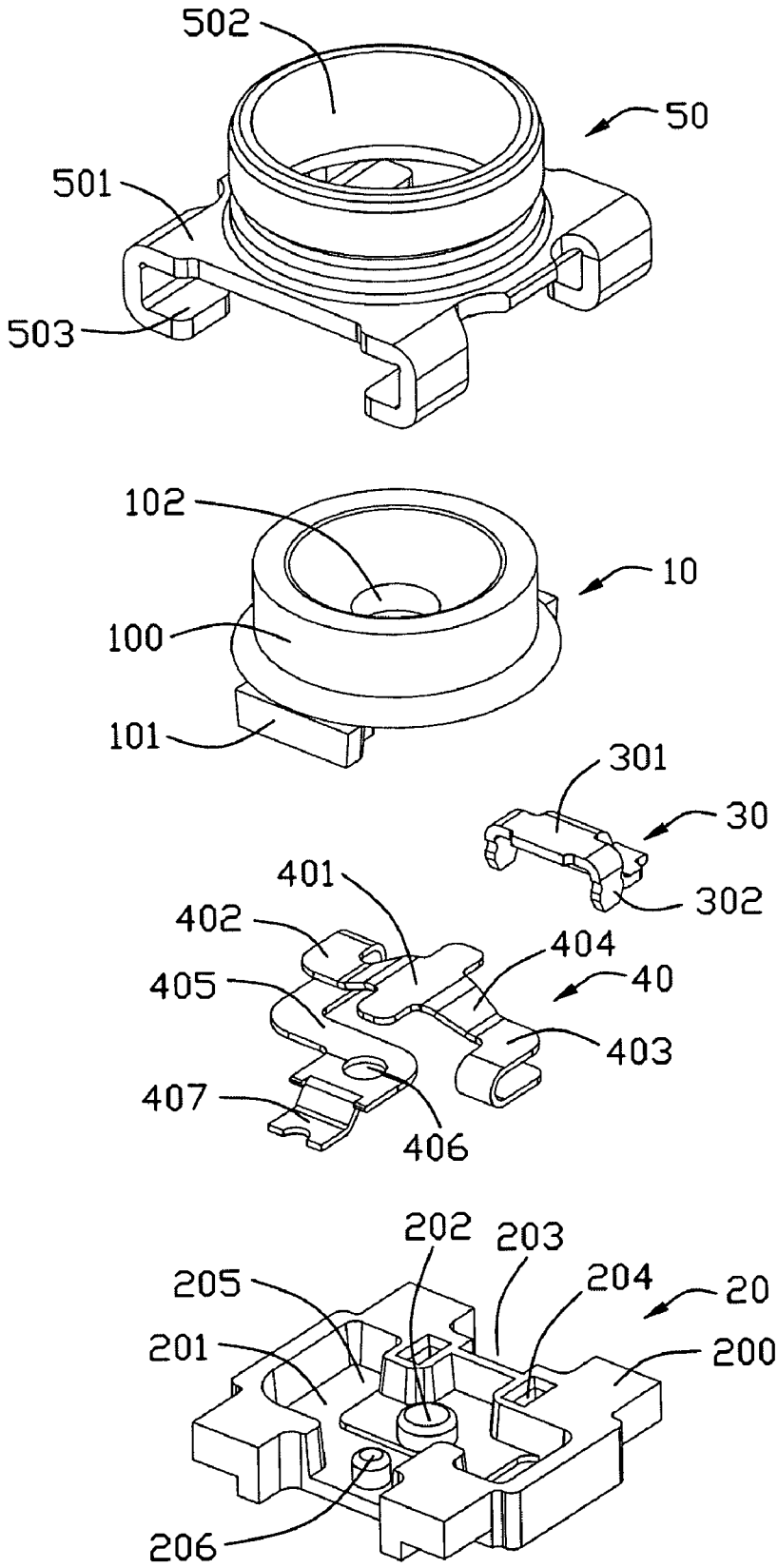
FIG. 2 is an exploded, perspective view of a RF connector embodying the concepts of the invention.
Figure 3:
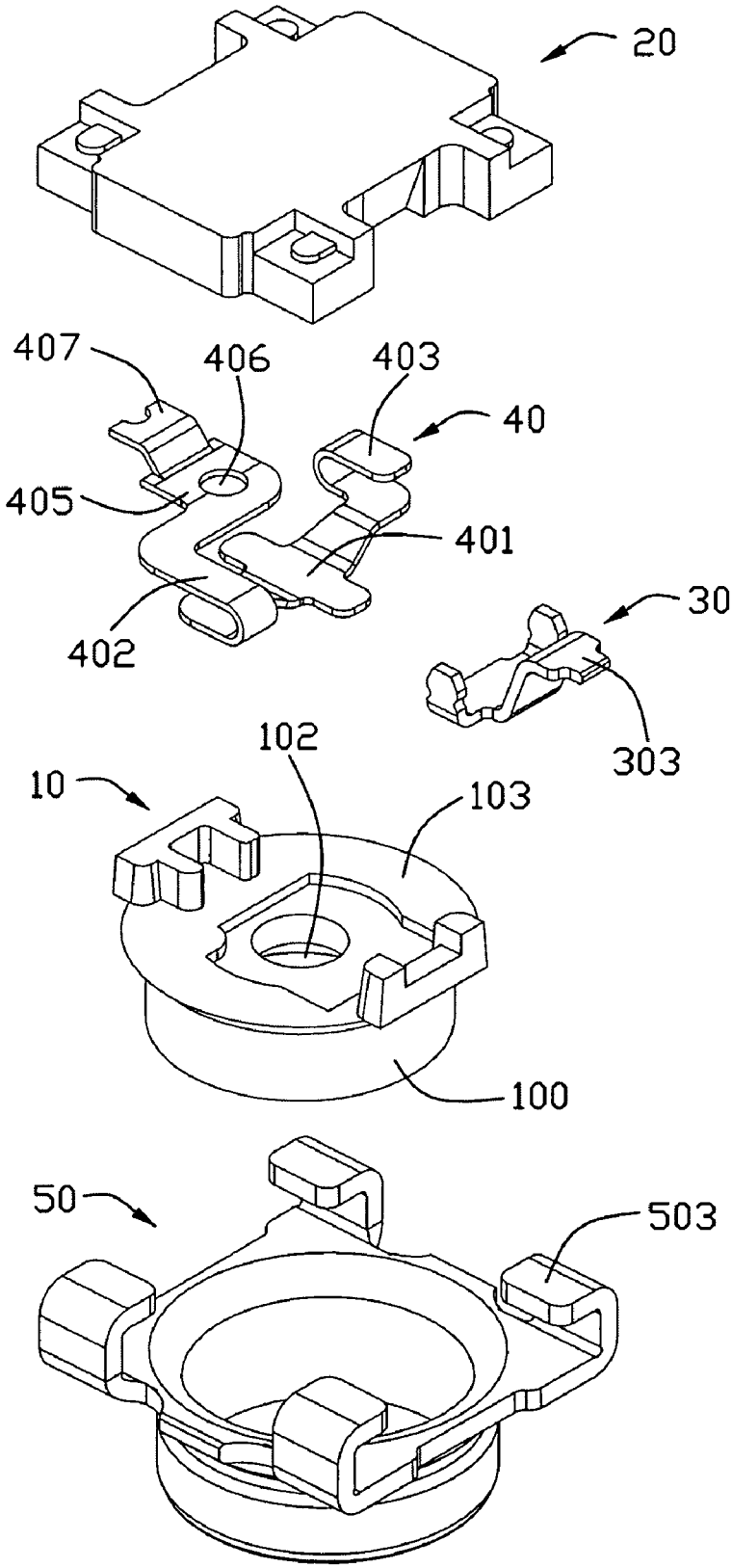
FIG. 3 is another exploded, perspective view of a RF connector.
Figure 4:
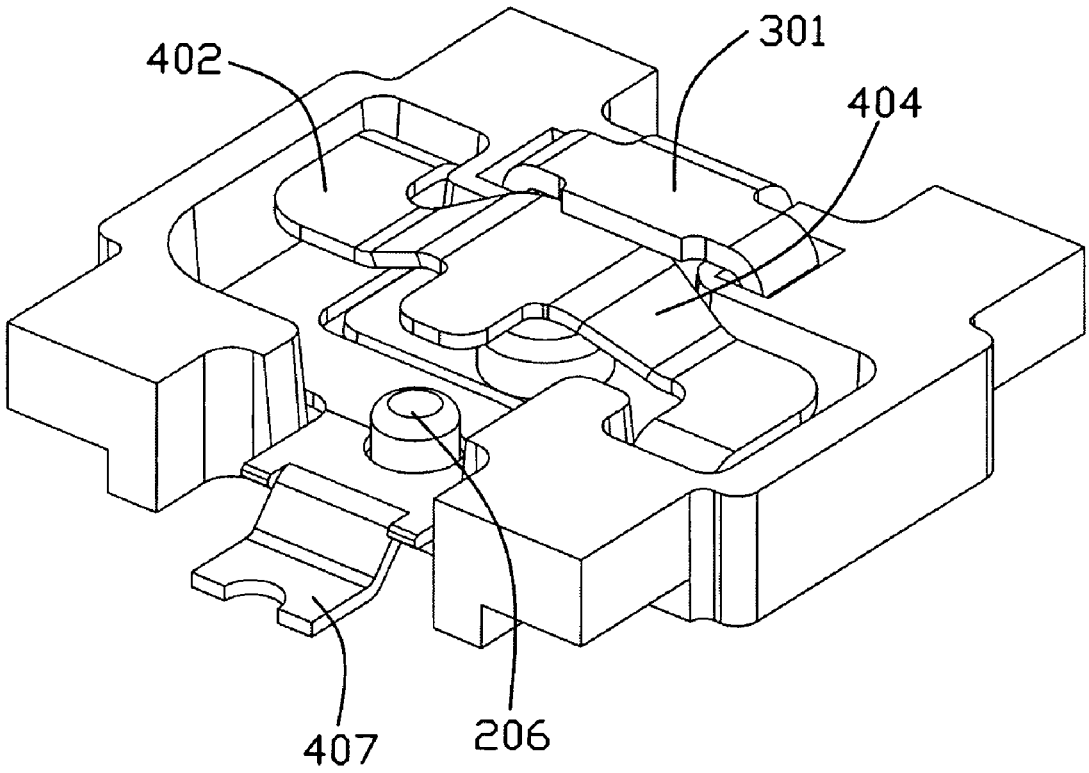
FIG. 4 is a partly-assembled, perspective view of the RF connector of FIG. 2, showing contacts assembly including an upper fixed contact and a lower movable contact assembled at an initial position where a complementary RF connector is detached.

Referring to FIGS. 2-3, the upper insulative case portion 10 includes a mating section 100 with a pair of retention blocks 101 defined on a bottom surface 103 symmetrically. A pin hole 102 for receiving a contact of a mating coaxial connector runs through the upper insulative case portion 10 along a direction which is perpendicular to the bottom surface 103.

The lower insulative case portion 20 includes a base section 200 having a space section 201 for receiving the lower movable contact 40, the lower movable contact 40 stacked in a vertical direction in the space section 201, which reduces a transverse width of the space section 201 and thereby achieves a mini-connector; a first tuber 202 is defined on the bottom of the space section 201 to support the lower movable contact 40 to a level at which a central planar contact section 401 of the lower movable contact 40 will not come in contact with the bottom fixed portion 405, even when the lower movable contact 40 moves downwardly by an external force from a complementary RF connector to be inserted into the connector. A second tuber 206 is also defined in the receiving space 201 to retain the lower movable contact 40. Two cutouts 203 are separately defined on two opposite sides of the lower insulative case portion 20, the cutouts 203 cooperate with the retention blocks 101 to hold the upper fixed contact 30 in position. A pair of depressions 204 is defined on a side of the lower insulative case portion 20 for the upper fixed contact 30 to be retained therein. A receiving groove 205 is defined on the bottom of the space section 201 for receipt of the bottom fixed portion 405.

Referring to FIG. 1 and FIG. 2, the upper fixed contact 30 arranged to be sandwiched by the upper insulative case portion 10 and the lower insulative case portion 20, the upper fixed contact 30 has a planar contact part 301 along a lengthwise direction; a pair of retention legs 302 are defined on the two free ends of the planar contact part 301, and an extending tail 303 extends from another side of the planar contact part 301, the extending tail 303 is received in one of the cutout 203.

The movable contact 40 has a central planar contact section 401, along a transverse direction perpendicular to said lengthwise direction, that is movable and elastic, the central planar contact section 401 arranged to initially come into contact with the contact part of the upper fixed contact 301, the movable contact 40 further including first and second bending ends 402, 403 integrally connected to the central planar contact section 401 through a pair of buffering arm 404 defined on the opposite sides of the central planar contact section 401 symmetrically, and retained by the inner face of the lower insulative case portion 20, said first bending end 402 and second bending end 403 are lying U-shaped. A bottom fixed portion 405 extends from a free end of the first bending end 402 horizontally, and retained with the second tuber 206 through a mounting hole 406 defined thereon. A soldering tail 407 extends out of the base section 200 from the end of the bottom fixed portion 405 for soldering onto the printed circuit board (not shown).

A metal shell 50 having planar section 501 with a mating permanency 502 protruding therefrom. A plurality of locking barbs 503 is defined on the opposite sides of the planar section 601 symmetrically.

After assembly, the central planar contact section 401 of the lower movable contact 40 is arranged to be movable from a position at which the movable contact 40 is in contact with the upper fixed contact 30 to a position at which the lower movable contact 40 is separated from the upper fixed contact 30. The central planar contact section 401 ensures that a central contact of a mating coaxial connector can make contact with the lower movable contact 40 flatly, and prevents the central contact from misconnecting with the movable contact 40.

While preferred embodiment in accordance with the present invention have been shown and described, equivalent modifications and changes known to persons skilled in the art according to the spirit of the present invention are considered within the scope of the present invention as defined in the appended claims.

What is claimed is:

1. A RF connector for receipt of a central contact of a mating coaxial connector to be inserted therein, comprising:

an insulative case including an upper insulative case portion and a lower insulative case portion, the lower insulative case portion defining a space section thereof;

an upper fixed contact and a lower movable contact essentially stacked in a vertical direction and received in the space section;

the upper fixed contact arranged to be sandwiched by the upper insulative case portion and the lower insulative case portion, the upper fixed contact having a planar contact part along a lengthwise direction; a pair of retention legs are defined on the two free ends of the planar contact part;

the lower movable contact having a central planar contact section, along a transverse direction perpendicular to said lengthwise direction, the central planar contact section arranged to initially come into contact with the contact part of the upper fixed contact, the movable contact further including first and second bending ends integrally connected to the central planar contact section and retained by the lower insulative case portion, the bending ends are elastic, a soldering tail retainably extending out of the lower insulative case portion; and wherein the contact section of the lower movable contact is arranged to be movable from a position at which the movable contact is in contact with the upper fixed contact to a position at which the movable contact is separated from the upper fixed contact in accordance with attachment and detachment of a complementary coaxial connector;

wherein the first and second bending ends are lying U-shaped.

2. The RF connector as recited in claim 1, wherein a pair of depressions is defined in the insulative base, the retention legs of the upper fixed contact retain in the depressions correspondingly.

3. The RF connector as recited in claim 1, wherein the first and second bending ends connect with the central planar contact section through a pair of buffering arm defined therebetween correspondingly.

4. The RF connector as recited in claim 1, wherein a pair of cutouts is defined on two opposite sides of the lower insulative case portion.

5. The RF connector as recited in claim 4, wherein a pair of retention blocks is defined on the upper insulative case portion to cooperate with the cutouts interferentially.

6. The RF connector as recited in claim 1, wherein a tuber is defined on the bottom of the space section supporting the central planar contact section of the lower movable contact.

7. A RF connector comprising:

an insulative housing defining a space section;

an upper fixed contact and a lower movable contact are disposed on two opposite sides of the housing in a first direction, each of said upper fixed contact and said lower movable contact including a contact section in the space section and a solder tail exposed outside of the housing, the lower movable contact having on two opposite sides a pair of bending ends each defining a lying U-shape; and an upper case mounted upon the housing and defining a plug insertion passageway; and a metallic shell enclosing said upper case and the housing.

8. The RF connector as claimed in claim 7, wherein the second direction is perpendicular to the first direction.

9. The RF connector as claimed in claim 7, wherein said housing defines a channel and the lower movable contact defines a wing to move along said channel during up-and-down movement of the moveable contact.

10. The RF connector as claimed in claim 9, wherein said wing of the lower movable contact is located in an opposite direction of the upper contact section of the lower movable contact.

11. An RF connector comprising:

an insulative case including an upper portion and a lower portion, said upper portion including a tubular mating section defining a pin hole therein;

a fixed contact retained in the insulative case and defining a fixed contact part; and a moveable contact retained in the insulative case and defining a moveable contact section having a first region constantly contacting the fixed contact part when no plug is inserted into the pin hole, and a second region spaced from the first region in a longitudinal direction and vertically aligned with and located under the pin hole;

wherein said moveable contact section is equipped with two supporting ends located by two sides of the second region so as to allow said second region to be upwardly supportably up and down moveable relative to the insulative case when a plug is downwardly inserted into the pin hole to downwardly urge said moveable contact section;

wherein said two supporting ends are located by said two sides of the second region in a transverse direction perpendicular to said longitudinal direction defined;

wherein at least one of said supporting ends defines a horizontal U-shaped structure with opposite upper and lower arms thereof to provide elasticity of said moveable contact thereof.

12. The RF connector as claimed in claim 11, wherein said moveable contact further includes a soldering tail located around a bottom face of the lower portion and essentially extending from a lower arm of said U-shaped structure.

13. The RF connector as claimed in claim 11, wherein said U-shaped structure extends along the longitudinal direction.

14. The RF connector as claimed in claim 13, wherein said moveable contact further includes another horizontal U-shaped structure at the other end.

15. The RF connector as claimed in claim 14, wherein said two horizontal U-shaped structures extend along the longitudinal direction.

16. The RF connector as claimed in claim 15, wherein openings of said two horizontal U-shaped structures direct opposite to each other for counterbalancing elasticity derived from said two horizontal U-shaped structures.

* * * * *